US005227016A

United States Patent [19]

Carlson et al.

[11] Patent Number: 5,227,016

[45] Date of Patent: Jul. 13, 1993

[54] PROCESS AND COMPOSITION FOR DESMUTTING SURFACES OF ALUMINUM AND ITS ALLOYS

[75] Inventors: Lawrence R. Carlson, Waterford; Dennis A. Kent, Rochester Hills, both of Mich.

[73] Assignee: Henkel Corporation, Ambler, Pa.

[21] Appl. No.: 846,299

[22] Filed: Feb. 25, 1992

[51] Int. Cl.[5] ..... B44C 1/22; C23F 1/00; C09K 13/04; C09K 13/06

[52] U.S. Cl. ..... 156/665; 134/3; 156/903; 252/79.2; 252/79.3; 252/79.4

[58] Field of Search ..... 156/656, 665, 903; 252/79.2, 79.3, 79.4; 134/2, 3, 41; 427/309

[56] References Cited

U.S. PATENT DOCUMENTS

| | | | |
|---|---|---|---|
| 2,867,514 | 1/1959 | Newhard et al. | 156/665 |
| 3,202,612 | 8/1965 | Nelson | 252/79.2 |
| 3,448,055 | 6/1969 | Mickelson et al. | 252/79.3 |
| 3,510,430 | 5/1970 | Mickelson et al. | 252/79.1 |
| 3,634,262 | 1/1972 | Grunwald et al. | 252/100 |
| 3,647,698 | 3/1972 | Bellinger et al. | 252/79.4 |

FOREIGN PATENT DOCUMENTS

| | | |
|---|---|---|
| 59-001699 | 1/1984 | Japan . |
| 1399111 | 10/1975 | United Kingdom . |

OTHER PUBLICATIONS

Research Disclosure 273,037-01-10-87 (abstract).

*Primary Examiner*—William A. Powell
*Attorney, Agent, or Firm*—Ernest G. Szoke; Wayne C. Jaeschke; Norvell E. Wisdom, Jr.

[57] ABSTRACT

A highly effective deoxidizer/desmutter for aluminum surfaces, particularly those of high silicon aluminum alloys, is an aqueous solution containing an oxidizing inorganic acid, phosphoric and sulfuric acids, simple and complex fluoride ions, an organic carboxylic acid having from 1-10 carbon atoms, and manganese in its +4 oxidation state.

20 Claims, No Drawings

PROCESS AND COMPOSITION FOR DESMUTTING SURFACES OF ALUMINUM AND ITS ALLOYS

BACKGROUND OF THE INVENTION

1. Field of the Invention

This invention relates to a process for desmutting aluminum and aluminum alloy surfaces, especially those of high silicon aluminum alloys, by contacting the surfaces with a particular aqueous liquid composition.

2. Statement of Related Art

Common chemical and even mechanical treatments of aluminum often leave the surface with a dark coating that must be removed before subsequent surface finishing steps can be satisfactorily completed. This process is generally known in the art as "desmutting" or sometimes as "deoxidizing". Current commercial desmutting practice normally uses oxidizing acid solutions containing some form of chromium(VI). This material, of course, has severe pollution potential, so that an alternative, equally effective desmutting composition and/or process would be highly desirable.

Some desmutting compositions without chromium have previously been known in the art. For example, "Research Disclosure" 273,037 according to an abstract thereof teaches desmutting in concentrated nitric acid; Japanese Laid-Open Patent Application 59-1,699 according to an abstract thereof teaches desmutting in a mixture of nitric and hydrochloric acids; published British patent application GB 1,399,111 according to an abstract thereof teaches desmutting with a solution of ammonium persulfate, sodium bisulfate, and ammonium nitrate; U.S. Pat. No. 3,634,262 according to an abstract thereof teaches desmutting in a solution containing alkali, alkaline earth, or ammonium peroxydisulfate(s); acid salts of sulfuric acid; and, optionally, fluorides; U.S. Pat. No. 3,647,698 according to an abstract thereof teaches desmutting with a solution of urea nitrate and ferric sulfate, optionally also including boric acid and/or fluoride ions; and U.S. Pat. No. 3,510,430 according to an abstract thereof teaches desmutting with a solution of ferric sulfate, alkali metal bisulfate, alkali metal nitrate, and alkali metal silicofluoride. None of these teachings is believed to have achieved substantial commercial success.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the exact numerical limits stated is generally preferred. Also, in this description and claims, except where the context implies otherwise, the term "aluminum" is to be understood to include all the alloys of aluminum that contain at least 45% by weight of aluminum.

SUMMARY OF THE INVENTION

It has surprisingly been found that the presence of manganese(IV) in desmutting solutions improves their performance. More specifically, a desmutting composition according to this invention includes an oxidizing inorganic acid, phosphoric and sulfuric acids, simple and complex fluoride ions, an organic carboxylic acid having from 1–10 carbon atoms, and manganese in its +4 oxidation state. A process according to this invention comprises a step of bringing a composition according to the invention into contact with an aluminum surface under conditions that result in removal of smut or other oxide or soil from the aluminum surface.

DESCRIPTION OF PREFERRED EMBODIMENTS

The preferred oxidizing acid is nitric acid. Other suitable oxidizing acids are perchloric and peroxy acids. In a working composition according to this invention, i.e., one suitable for direct use in desmutting, the concentration of oxidizing acid is preferably in the range from 151 to 251, more preferably from 174 to 228, or still more preferably from 191 to 211 grams per liter (hereinafter "g/L").

The preferred source of simple fluoride ions is hydrofluoric acid and the preferred source of complex fluoride ions is fluosilicic acid ($H_2SiF_6$), but fluotitante ($TiF_6^{-2}$), fluoborate ($BF_4$), and fluozirconate ($ZrF_6^{-2}$) ions, preferably from their corresponding acids, are also suitable. The preferred ratio by weight of simple fluoride ions to oxidizing acid in a composition according to this invention is from 0.103:1 to 0.114:1, more preferably from 0.105:1 to 0.112:1, or still more preferably from 0.107:1 to 0.111:1. The preferred ratio by weight of complex fluoride ions to oxidizing acid in a composition according to this invention is from 0.011:1 to 0.016:1, more preferably from 0.012:1 to 0.015:1, or still more preferably from 0.013:1 to 0.014:1.

The preferred ratio by weight of sulfuric acid to oxidizing acid in a composition according to this invention is from 0.45:1 to 0.55:1, more preferably from 0.47:1 to 0.52:1, or still more preferably from 0.49:1 to 0.51:1. The preferred ratio by weight of phosphoric acid to oxidizing acid in a composition according to this invention is from 0.086:1 to 0.095:1, more preferably from 0.088:1 to 0.093:1, or still more preferably from 0.089:1 to 0.91:1.

The preferred organic carboxylic acid in a composition according to this invention is acetic acid. The preferred ratio by weight of carboxylate groups to oxidizing acid in a composition according to this invention is from 0.082:1 to 0.153:1, more preferably from 0.092:1 to 0.143:1, or still more preferably from 0.105:1 to 0.128:1.

No salts of Mn(IV) are commercially available at a reasonable price, and manganese dioxide has not proved convenient to use in practice in preparing compositions according to the invention. Therefore, the preferred source of Mn(IV) is an in situ reaction between Mn(II) and a suitable oxidizing agent, most preferably hydrogen peroxide. Manganese nitrate is the preferred source of the Mn(II) starting material, primarily because it is the most soluble of the readily available salts of Mn(II); manganese acetate, manganese formate, manganese sulfate and/or fluosilicate are also suitable. In order to minimize the chances of precipitation or other undesired instability of the compositions according to this invention, it is preferred to oxidize the manganese content of a partially completed composition to the +4 oxidation state before adding any significant fraction of the intended eventual simple fluoride ion content of the composition to it. This is illustrated in the examples below.

The ratio by weight of the $Mn^{+2}$ ions, later to be oxidized to $Mn^{+4}$, to the inorganic oxidizing acid present in the working compositions according to this invention preferably is 0.047:1 to 0.087:1, more preferably from 0.057:1 to 0.077:1, or still more preferably from 0.062:1 to 0.072:1.

In all the ratios above, when Nitric acid is the inorganic oxidizing acid, its weight is to be taken as that of 100% concentrated nitric acid ($HNO_3$). If another inorganic oxidizing acid is used, the ratios should preferably be adjusted to provide the same amount of strong acid protons from the inorganic oxidizing acid as would be obtained with the ratios stated above when using nitric acid.

Working compositions according to the invention preferably have from 8.8 to 13.8, more preferably from 9.8 to 12.8, or still more preferably from 10.5 to 12.3 "points of free acid" and, independently, preferably have from 10.2 to 15.2, more preferably from 11.2 to 14.2, or still more preferably from 11.7 to 12.7 "points of total acid". These "points" are determined as follows: 1 milliliter (hereinafter "ml") of the composition is diluted to 50 ml with deionized water and titrated with 1.0 N strong base solution (usually sodium hydroxide), using a bromphenol blue indicator for "free acid" and a phenolphthalein indicator for "total acid". The number of points equals the number of milliliters of the titrant required to the end point.

Working compositions according to this invention are more concentrated in active ingredients than are many other types of treatment solutions. Nevertheless, it may be economically advantageous to ship the compositions in concentrated form, which can be made ready for use by dilution with water at the point of use. Such concentrated compositions, either concentrates of complete working compositions, or of two or more separate partial compositions that can be mixed with water and one another to form working compositions, are within the contemplated scope of this invention.

The compositions according to the invention have proved to be particularly effective in desmutting and/or deoxidizing aluminum casting alloys containing from 5–12 % by weight of silicon, and also on certain other alloys containing not more than 98% of aluminum by weight. A group of preferred alloys to be treated according to the invention is given in Table 1. Among these the first nine listed are most preferred. A tenth member of this most preferred group is an alloy designated # 713 by the Outboard Marine Corporation, 100 Sea Horse Drive, Waukegan, IL 60085. This contains 11–13 parts by weight of silicon, not more than 1 parts by weight of iron, not more than 0.6 parts by weight of copper, not more than 0.5 parts by weight of zinc, not more than 0.35 parts by weight of magnesium, not more than 0.1 parts by weight of manganese, and not more than 0.5 parts by weight of nickel, with the balance aluminum.

COMPOSITIONS OF PREFERRED ALLOYS TO BE TREATED

| AA No. | Former AA No. | Former ASTM No. | Content in Percent by Weight of: Cu | Mg | Mn | Si | Zn | Cr | Fe |
|---|---|---|---|---|---|---|---|---|---|
| 336.0[1] | A332.0 | SN122A | 1.0 | 1.0 | — | 12.0 | — | — | — |
| 354.0 | 354 | SC92A | 1.8 | .50 | — | 9.0 | — | — | — |
| 355.0 | 355 | SC61A | 1.2 | .50 | .50[2] | 5.0 | .35[2] | — | 0.6[2] |
| C356.0 | C355 | SC61B | 1.2 | .50 | .10[2] | 5.0 | .10[2] | — | .20[2] |
| 356.0 | 356 | SG70A | .25[2] | .32 | .35[2] | 7.0 | .35[2] | — | 0.6[2] |
| A356.0 | A356 | SG70B | .20[2] | .35 | .10[2] | 7.0 | .10[2] | — | .20[2] |
| 357.0 | 357 | — | — | .50 | — | 7.0 | — | — | — |
| A357.0[3] | A357 | — | — | 0.6 | — | 7.0 | — | — | — |
| 359.0 | 359 | SG91A | — | 0.6 | — | 9.0 | — | — | — |
| 2024 | — | — | 4.4 | 0.5 | 0.8 | — | — | — | — |
| 6061 | — | — | .28 | 1.0 | — | 0.6 | — | 0.2 | — |
| 7075 | — | — | 1.6 | 2.5 | — | — | 5.6 | .23 | — |

Footnotes for Table 1
[1]Also contains 2.5% of Ni
[2]Indicates maximum amount
[3]Also contains 0.16% of Ti and 0.006% of Be
Other Notes for Table 1
AA numbers are assigned by the Aluminum Association, which has a mailing address of 818 Connecticut Avenue, N.W., Washington, DC 20006.
The balance of the composition not shown for each alloy is aluminum.

The compositions according to the invention are effective at temperatures within the range of at least 10°–35° C., which includes the ambient temperature in almost any enclosed space in which the temperature is controlled for human comfort. Most preferably, a process according to the invention, which in its simplest form consists of contacting an aluminum workpiece with a composition according to the invention as described above, is performed at a temperature in the range from 18°–21° C. The contact time should be sufficient to produce the desired matte white and stain-free appearance on the surface of the aluminum workpiece(s) to be treated. Times from 15–120 seconds have proved effective in practice.

Before using a desmutting composition according to the invention, the aluminum workpieces are preferably freed from any gross surface contamination such as burrs, shavings, and chips and cleaned with a conventional cleaner as known in the art. Preferably the cleaner used is of the silicated alkaline immersion type. After treatment with a composition according to this invention, the workpieces are preferably rinsed with water, more preferably including a final rinse with deionized water. The workpieces may then be subjected to further surface treatments such as conversion coating, anodization, painting, and the like, as known per se in the art.

The compositions according to the invention as described above are those prepared fresh for use and are generally colorless. As the compositions are used, they gradually develop a pink color, presumably because of the reduction of Mn(IV) to Mn(II). It is advantageous in a process according to this invention to add a suitable oxidizing agent, preferably hydrogen peroxide, occasionally during use in a sufficient amount to remove the pink color. In long term use, all components of the composition will eventually need replenishment.

The practice of the invention may be further appreciated from the following non-limiting examples.

EXAMPLES

A first component composition for use in the invention was made by mixing the following ingredients in the order given:

| Ingredient | Amount in Parts by Weight |
|---|---|
| Deionized water | 267.3 |
| Concentrated nitric acid (42° Baumè) | 561.0 |
| 75% aqueous orthophosphoric acid ($H_3PO_4$) | 45.4 |
| Glacial acetic acid | 33.3 |
| 50% aqueous solution of $Mn(NO_3)_2$ | 93.0 |

A second component composition for use in the invention was made by mixing the following ingredients in the order given:

| Ingredient | Amount in Parts by Weight |
|---|---|
| Concentrated sulfuric acid (66° Baumè) | 105.9 |
| A mixture of 50% by weight deionized water and 50% by weight of 66° Baumè sulfuric acid | 702.4 |
| 70% aqueous hydrofluoric acid (HF) | 144.0 |
| 25% aqueous solution of fluosilicic acid ($H_2SiF_6$) | 47.7 |

To 70 parts by weight of the first component noted above were added 2 parts by weight of 35% aqueous hydrogen peroxide solution, with stirring. A vigorous evolution of gas bubbles, indicating the oxidation of the manganese content of the component to its +4 oxidation state, then occurred. After the evolution of gas was complete, 30 parts by weight of the second component noted above was added to this mixture, with stirring, to produce a working composition according to this invention.

Workpieces of each of the types of aluminum alloy shown in Table 1 and of Outboard Marine Corporation Alloy #713 as described were cleaned by immersion in a commercial silicated alkaline cleaner formulated for such uses, rinsed with water, and then dipped into a container of the composition according to the invention made as described above. The composition was maintained at a temperature between 18° and 21° C., and the workpieces were maintained in contact with the composition for periods of time ranging from 15–200 seconds. In each case, an apparently clean, white matte surface that was free from any visual evidence of pitting or intergranular attack was produced on the workpieces. The surfaces were well suited for conventional organic coatings.

What is claimed is:

1. A liquid solution composition of matter consisting essentially of water and:
   (A) an oxidizing inorganic acid;
   (B) phosphoric acid;
   (C) sulfuric acid;
   (D) a source of simple fluoride ions;
   (E) a source of complex fluoride ions;
   (F) an organic carboxylic acid having from 1–10 carbon atoms per molecule; and
   (G) a source of manganese in its +4 oxidation state, 2. A composition according to claim 1, wherein the inorganic oxidizing acid is nitric acid, the source of simple fluoride ions is hydrofluoric acid, the source of complex fluoride ions is fluosilicic acid, the organic carboxylic acid is acetic acid, and the manganese in its +4 oxidation state is produced in situ by oxidizing $Mn^{+2}$ ions with hydrogen peroxide.

3. A composition according to claim 2, wherein the concentration of oxidizing inorganic acid is from about 151 to about 251 g/L, the ratio by weight of simple fluoride ions to oxidizing inorganic acid is from about 0.103:1 to about 0.114:1, the ratio by weight of complex fluoride ions to oxidizing acid is from about 0.011:1 to about 0.016:1, the ratio by weight of sulfuric acid to oxidizing inorganic acid is from about 0.45:1 to about 0.55:1, the ratio by weight of phosphoric acid to oxidizing inorganic acid is from about 0.086:1 to about 0.095:1, the ratio by weight of carboxylate groups to oxidizing inorganic acid is from about 0.082:1 to 0.153:1, the ratio by weight of manganese to oxidizing inorganic acid is from 0.047:1 to 0.087:1, the points of free acid are from 8.8 to 13.8, and the points of total acid are from 10.2 to 15.2.

4. A composition according to claim 3, wherein the concentration of oxidizing inorganic acid is from about 174 to about 228 g/L, the ratio by weight of simple fluoride ions to oxidizing inorganic acid is from about 0.105:1 to about 0.112:1, the ratio by weight of complex fluoride ions to oxidizing acid is from about 0.013:1 to about 0.015:1, the ratio by weight of sulfuric acid to oxidizing inorganic acid is from about 0.47:1 to about 0.52:1, the ratio by weight of phosphoric acid to oxidizing inorganic acid is from about 0.088:1 to about 0.093:1, the ratio by weight of carboxylate groups to oxidizing inorganic acid is from about 0.105:1 to 0.128:1, the ratio by weight of manganese to oxidizing inorganic acid is from 0.023–0.027, the points of free acid are from 10.3 to 12.3, and the points of total acid are from 11.7 to 13.7.

5. A composition according to claim 1, said composition having been prepared by the steps of:
   (I) from 1–5 parts by weight of about 35% aqueous hydrogen peroxide with 70 parts of by weight of a solution consisting of 440 to 70 parts by weight of deionized water, 427 to 712 parts by weight of concentrated nitric acid (42° Baumè), 35–58 parts by weight of 75% aqueous orthophosphoric acid ($H_3PO_4$), 25 to 42 parts by weight of glacial acetic acid, and 71–118 parts by weight of a 50% by weight aqueous solution of $Mn(NO_3)_2$;
   (II) allowing the mixture prepared in step (I) to sit until the evolution of visible gas bubbles therefrom has ceased; and
   (III) mixing with the composition from the end of step (II) 30 parts by weight of another composition consisting of 407 to 507 parts by weight of concentrated sulfuric acid (66 Baumè), 418 to 227 parts by weight of deionized water, 136 to 151 parts by weight of 70% aqueous hydrofluoric acid, and 40 to 58 parts by weight of 25% aqueous solution of fluosilicic acid ($H_2SiF_6$).

6. A composition according to claim 5, said composition having been prepared by the steps of:
   (I) mixing 2 parts by weight of 35% aqueous hydrogen peroxide with 70 parts of by weight of a solution consisting of 267.3 parts by weight of deionized water, 561.0 parts by weight of concentrated nitric acid (42° Baumè), 45.4 parts by weight of 75% aqueous orthophosphoric acid ($H_3PO_4$), 33.3 parts by weight of glacial acetic acid, and 93.0 parts by weight of 50% aqueous solution of $Mn(NO_3)_2$;

(II) allowing the mixture prepared in step (I) to sit until the evolution of visible gas bubbles therefrom has ceased; and (III) mixing with the composition from the end of step (II) 30 parts by weight of another composition consisting of 457 parts by weight of concentrated sulfuric acid (66° Baumè), 351.2 parts by weight of deionized water, 144.0 parts by weight of 70% aqueous hydrofluoric acid, and 47.7 parts by weight of 25% aqueous solution of fluosilicic acid ($H_2SiF_6$).

7. An aqueous solution composition of matter, consisting essentially of 442–70 parts by weight of water, 427 to 712 parts by weight of concentrated nitric acid (42° Baumè), 35–58 parts by weight of 75% aqueous orthophosphoric acid ($H_3PO_4$), 25 to 42 parts by weight of glacial acetic acid, and 71–118 parts by weight of a 50% by weight aqueous solution of $Mn(NO_3)_2$.

8. An aqueous solution composition of matter, consisting essentially of 407 to 507 parts by weight of concentrated sulfuric acid (66° Baumè), 418 to 227 parts by weight of deionized water, 136 to 151 parts by weight of 70% aqueous hydrofluoric acid, and 40 to 58 parts by weight of 25% aqueous solution of fluosilicic acid ($H_2SiF_6$).

9. A process for desmutting, deoxidizing, or both desmutting and deoxidizing an aluminum surface, said process comprising contacting said aluminum surface with a composition according to claim 6 for a sufficient time at a sufficient temperature to be effective for desmutting or deoxidizing.

10. A process for desmutting, deoxidizing, or both desmutting and deoxidizing an aluminum surface, said process comprising contacting said aluminum surface with a composition according to claim 5 for a sufficient time at a sufficient temperature to be effective for desmutting or deoxidizing.

11. A process for desmutting, deoxidizing, or both desmutting and deoxidizing an aluminum surface, said process comprising contacting said aluminum surface with a composition according to claim 4 for a sufficient time at a sufficient temperature to be effective for desmutting or deoxidizing.

12. A process for desmutting, deoxidizing, or both desmutting and deoxidizing an aluminum surface, said process comprising contacting said aluminum surface with a composition according to claim 3 for a sufficient time at a sufficient temperature to be effective for desmutting or deoxidizing.

13. A process for desmutting, deoxidizing, or both desmutting and deoxidizing an aluminum surface, said process comprising contacting said aluminum surface with a composition according to claim 2 for a sufficient time at a sufficient temperature to be effective for desmutting or deoxidizing.

14. A process for desmutting, deoxidizing, or both desmutting and deoxidizing an aluminum surface, said process comprising contacting said aluminum surface with a composition according to claim 1 for a sufficient time at a sufficient temperature to be effective for desmutting o deoxidizing.

15. A process according to claim 14, wherein the aluminum surface is the surface of an aluminum alloy selected from the group consisting of alloys with from 5–12% by weight of silicon and the temperature during the process is in the range from 10° to 35° C.

16. A process according to claim 13, wherein the aluminum surface is the surface of an aluminum alloy selected from the group consisting of alloys with from 5–12% by weight of silicon and the temperature during the process is in the range from 10° to 35° C.

17. A process according to claim 12, wherein the aluminum surface is the surface of an aluminum alloy selected from the group consisting of alloys with from 5–12% by weight of silicon and the temperature during the process is in the range from 10° to 35° C.

18. A process according to claim 11, wherein the aluminum surface is the surface of an aluminum alloy selected from the group consisting of alloys with from 5–12% by weight of silicon and the temperature during the process is in the range from 10° to 35° C.

19. A process according to claim 10, wherein the aluminum surface is the surface of an aluminum alloy selected from the group consisting of alloys with from 5–12% by weight of silicon and the temperature during the process is in the range from 10° to 35° C.

20. A process according to claim 9, wherein the aluminum surface is the surface of an aluminum alloy selected from the group consisting of alloys with from 5–12% by weight of silicon and the temperature during the process is in the rang from 10° to 35° C.

* * * * *